US006003360A

United States Patent [19]

Runk et al.

[11] Patent Number: 6,003,360

[45] **Date of Patent: *Dec. 21, 1999**

[54] PRESS BRAKE TOOL HOLDER

[75] Inventors: David M. Runk, Stillwater; Kenneth J. Wilson, White Bear Lake; Jason A. Doolittle, Shoreview; Wayne F. Peloquin, Forest Lake; Richard L. Timp, Vadnais Heights, all of Minn.

[73] Assignee: Wilson Tool International, Inc., White Bear Lake, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/886,648

[22] Filed: Jul. 1, 1997

[51] Int. Cl.[6] ..... B21D 37/04

[52] U.S. Cl. ..... 72/482.2; 72/389.3; 72/462; 72/482.92

[58] Field of Search ..... 72/389.1, 389.3, 72/462, 481.1, 481.2, 482.2, 482.92, 482.1

[56] References Cited

U.S. PATENT DOCUMENTS

| | | |
|---|---|---|
| 4,408,522 | 10/1983 | Yamane . |
| 4,590,788 | 5/1986 | Wallis . |
| 5,009,098 | 4/1991 | van Merksteijn . |
| 5,022,256 | 6/1991 | van der Meulen . |
| 5,103,665 | 4/1992 | van Merksteijn . |
| 5,245,854 | 9/1993 | Bruggink et al. . |
| 5,390,527 | 2/1995 | Kawano . |
| 5,511,407 | 4/1996 | Kawano . |
| 5,513,514 | 5/1996 | Kawano . |
| 5,619,885 | 4/1997 | Kawano et al. . |
| 5,642,642 | 7/1997 | Kawano . |
| 5,685,191 | 11/1997 | Kawano et al. . |

FOREIGN PATENT DOCUMENTS

| | | |
|---|---|---|
| 644002 | 3/1995 | European Pat. Off. . |
| 0 754 506 | 1/1997 | European Pat. Off. . |
| 2 427 148 | 12/1979 | France . |
| 2 609 909 | 7/1988 | France . |
| 35 24 694 | 1/1987 | Germany . |
| 62 267019 | 11/1987 | Japan . |

*Primary Examiner*—David Jones
*Attorney, Agent, or Firm*—Fredrikson & Bryon, PA

[57] ABSTRACT

A press brake tool holder having a horizontally elongated body having a support plate, and a horizontally elongated clamp having upper and lower portions and pivotally attached to the body between the upper and lower portions so as to capture between it and the support plate the upwardly extending shank of a brake press tool. A handle-operated cam shaft is carried by the body and is linked to the upper portion of the clamp by cam follower elements which provide a rigid linkage. Clamps may be thus mounted to both sides of the body, and each can be independently operated when the other is removed. The clamp is mounted to the body by means of mounting pins having articulating heads that are slidingly received in slots in the body, the slots having enlarged entryways enabling the clamp to be removed from or attached to the body by sliding the clamp with respect to the body to align the articulating heads with the slot entryways.

19 Claims, 6 Drawing Sheets

PRESS BRAKE TOOL HOLDER

FIELD OF THE INVENTION

The present invention is in the field relating to press brakes of the type used to shape metal sheet material and to articles of manufacture, and particularly to holders that are employed to releasably hold forming tools in a press brake.

BACKGROUND OF THE INVENTION

Press brakes commonly are equipped with a lower table and an upper table, one of which, commonly the lower table, is vertically movable toward the other table. Forming tools are mounted to the tables so that when the tables are brought together, a workpiece between the forming tables is bent into an appropriate shape. It is common for the upper table to include a male forming die having a bottom workpiece-deforming surface of a desired shape, such as a right angled bend, and for the bottom table to have an appropriately shaped and aligned die so that when the die is brought together with the forming tool, a workpiece between the two is pressed by the forming tool into the die and thus is given an appropriate bent shape. The forming tools and dies commonly are horizontally elongated so that workpieces of various widths can be accommodated.

It often is necessary to exchange forming tools and dies when a different bending operation is to be performed. The dies, commonly resting on the bottom table of a press brake, are readily removed and exchanged for others. The forming tools that usually are mounted to the upper table of a press brake often are not easily replaced. Forming tools usually are held by a C clamp or other holder to the horizontally elongated bed of the upper table. Once the clamp has been loosened, the forming tool can, in some instances, be removed downwardly, and in others, must be removed by horizontally sliding it from the clamp. If a long forming tool is to be replaced, it becomes difficult to slide the forming tool from its clamp because of the proximity of neighboring clamps and forming tools which may themselves have to be removed in order to complete the tool exchange process.

Because long forming tools can be quite heavy, when a clamp is loosened to the point that the tool can be removed by moving it downwardly, a tool may slip and fall, causing potential injury to press brake operators.

Several press brake holders have been devised in an effort to facilitate the exchange of one forming tool for another. For example, Treillet, U.S. Pat. No. 4,993,255 discloses a tool holder that is attached by means of a C clamp to the bed of the upper table. Through the use of a camming mechanism, the upwardly extending shank of a forming tool is captured between a pivotable clamp and a portion of the holder, the shank and clamp having cooperating surfaces enabling the tool to be readily inserted in the holder. A locking cam is employed to lock the clamp against the forming tool. Kawano, U.S. Pat. No. 5,513,514, U.S. Pat. No. 5,511,407, U.S. Pat. No. 5,572,902, and European patent publication 0 644 002 A2 show tool holders of the same general type in which a pivoting clamp is employed to receive the shank of a tool between it and the mounting plate of the holder. In each of these patents, the holder is equipped with a threaded mechanism operated by a lever that pivots from side to side to lock and unlock the clamp, force being transmitted from the lever to the clamp via a spring structure.

It remains difficult to remove a forming tool from a press brake holder, for the reasons stressed above. Care must be taken to avoid dropping press brake tooling as tools are exchanged in a press brake holder, and care must also be taken during attachment of a tool holder to the upper table of a press brake inasmuch as loosening of the clamps currently employed to hold a press brake holder to the bed may permit the holder to fall of its own weight. Moreover, with certain tool holders for forming tools, the force which the clamp exerts against the holder to maintain it in position varies along the length of the clamp; this, in turn, may cause unintentional movement of the forming tool with respect to the tool holder.

SUMMARY OF THE INVENTION

The present invention provides a holder for mounting a press brake tool having a horizontally elongated, upwardly extending mounting shank to a press brake. The holder includes a horizontally elongated body having a downwardly extending support plate that is configured to engage the shank of the tool. A bore is formed through the body above the support plate, the bore extending parallel to the long direction of the body. The holder includes a horizontally elongated clamp extending along the body and having upper and lower portions, the clamp being pivotally attached between its upper and lower portions to the body and pivotally moveable between clamped and unclamped positions. The lower portion of the clamp is positioned in opposition to and is spaced from the support plate, and is oriented to grasp between it and the support plate the shank of the tool when the lower clamp portion is pivoted toward the support plate. Rotatably received in the bore is an elongated cam shaft having a plurality of camming surfaces spaced along its length. The body includes a plurality of cam follower elements which are rigid (as opposed to being resilient) operatively positioned between the camming surfaces and the upper portion of the clamp for forcing the upper portion of the clamp outwardly from the body in response to rotation of the cam shaft, the lower portion of the clamp thus being forced toward the support plate as the clamp pivots into its clamped position to capture the tool shank between it and the support plate. A manually operated handle is releasably coupled to the cam shaft to enable the cam shaft to be rotated in one direction to move the clamp to its clamping position and in the other direction to release force on the clamp and permit it to return to its unclamped position.

Thus, force is transmitted from the cam shaft to the clamp to move the clamp to its clamped position through a mechanically rigid linkage, that is, without the use of resilient elements in the linkage. Because the cam shaft includes a plurality of spaced camming surfaces which in turn exert force against a plurality of cam follower elements that are positioned along the length of the upper surface of the clamp, the pressure exerted by the lower portion of the clamp against the tool shank is substantially uniform from one end of the clamp to the other.

Preferably, the holder of the invention includes a plurality of slots formed in the lower portion of the clamp that extend downwardly to define a plurality of individual finger elements, each of which is capable of resiliently and independently engaging the shank of the tool. In this manner, slight imperfections in the holder or in the forming tool shanks are accommodated easily.

In a preferred embodiment, the body of the tool holder includes an upwardly extending mounting plate that is mountable to the bed of a press brake, the mounting plate having a horizontally extending, downwardly facing shoulder. In this embodiment, a fastener is employed for mounting the mounting plate against the bed, the fastener being securely mountable to the bed and having an upwardly facing shoulder engaging the downwardly facing shoulder of the mounting plate to restrain accidental release of the mounting plate when the fastener is loosened from the bed.

Preferably, the tool holder of the invention includes a plurality of compressibly resilient elements, e.g., compression springs, between the clamp and the body and which urge the clamp away from the body. When the clamp is in its unclamped position, it can be pivoted against the springs to enable the shank of a tool to be inserted from beneath upwardly between the clamp and the support plate of the body. The tool shank and the clamp preferably have cooperating surface configurations that enable the clamp to capture the forming tool and prevent it from being accidentally released. Desirably, the bottom portion of the clamp is provided with a lip that extends toward the support plate of the body, the lip having a generally upwardly facing shoulder. To mate with the clamp, the forming tool desirably has a slot formed in its shank, the slot having a generally downwardly facing shoulder so positioned and oriented that when the tool is pushed upwardly between the clamp and support plate, the lip of the clamp is at least partially received in the slot with the upwardly facing shoulder of the lip engaging and supporting the downwardly facing shoulder of the slot. Thereafter, the cam shaft may be rotated about its axis to securely and firmly lock the tool shank between the clamp and support plate as the clamp assumes its clamped position.

The slot and shoulder structure described above also enables the forming tool to be removed downwardly with reasonable safety from the holder. In this process, the cam shaft is rotated to bring the clamp into its unclamped position. Manually pulling the bottom of the tool generally horizontally and perpendicular to the long direction of the holder, away from the clamp, causes the tool shank to pivot about the bottom edge of the support plate, the upper edge of the tool shank thus pressing outwardly upon the clamp which in turn resiliently pivots outwardly to enable the lip of the clamp to escape from the slot in the tool shank. The tool, being already firmly gripped, can then be lowered away from the holder.

In a preferred embodiment, the clamp or the body of the tool holder, preferably the body, is provided with a plurality of slots each having an undercut surface and each slot having a portion of increased width adjacent to its end. In this embodiment, the other of the clamp and the body is provided with respective mounting pins that extend outwardly and terminate in enlarged heads that are receivable within the enlarged ends of the slots. The heads and the undercut surfaces of the slots have engaging surfaces that permit articulation between the heads and the slots. To mount a clamp to the body, the articulating pin heads are inserted through the large opening in the slots and the clamp is slid along the surface of the body until the heads are received within the undercut surfaces of the slots with which they articulate. The enlarged articulating heads of the pins together define the pivot axis of the clamp with respect to the body. Preferably, the holder is provided with a plurality of compressibly resilient elements between the clamp and body that urge the clamp away from the body, thereby maintaining the articulating heads of the pivot pins in articulating contact with the undercut surfaces of the slots.

A manually operated lever is attached at one end to the cam shaft such that movement of the lever in a plane perpendicular to the long direction of the holder (that is, away from and toward the operator) will rotate the cam shaft between a locked position in which the clamp in its clamped position is clamped firmly against the shank of a forming tool, and an unlocked position in which the clamp, now in its unclamped position, can be resiliently pivoted with respect to the body. Movement of the handle toward and away from the pressbrake bed is a user-friendly motion that is easily controlled by an operator. The handle desirably is readily removed from the cam shaft so that it does not interfere with the operation of the press brake.

In its preferred embodiment, the holder of the invention comprises a pair of clamps, one on each side of the support plate. Rotation of the cam shaft operates to urge the upper portion of each clamp outwardly with resultant movement of the bottom portion of the clamps inwardly toward the support plate. Tooling can be mounted on either side of the support plate, the edge of the tooling that engages the workpiece lying in the same position regardless of which side of the support plate the tool shank is mounted to.

DESCRIPTION OF THE PREFERRED EMBODIMENT

Figure 1:
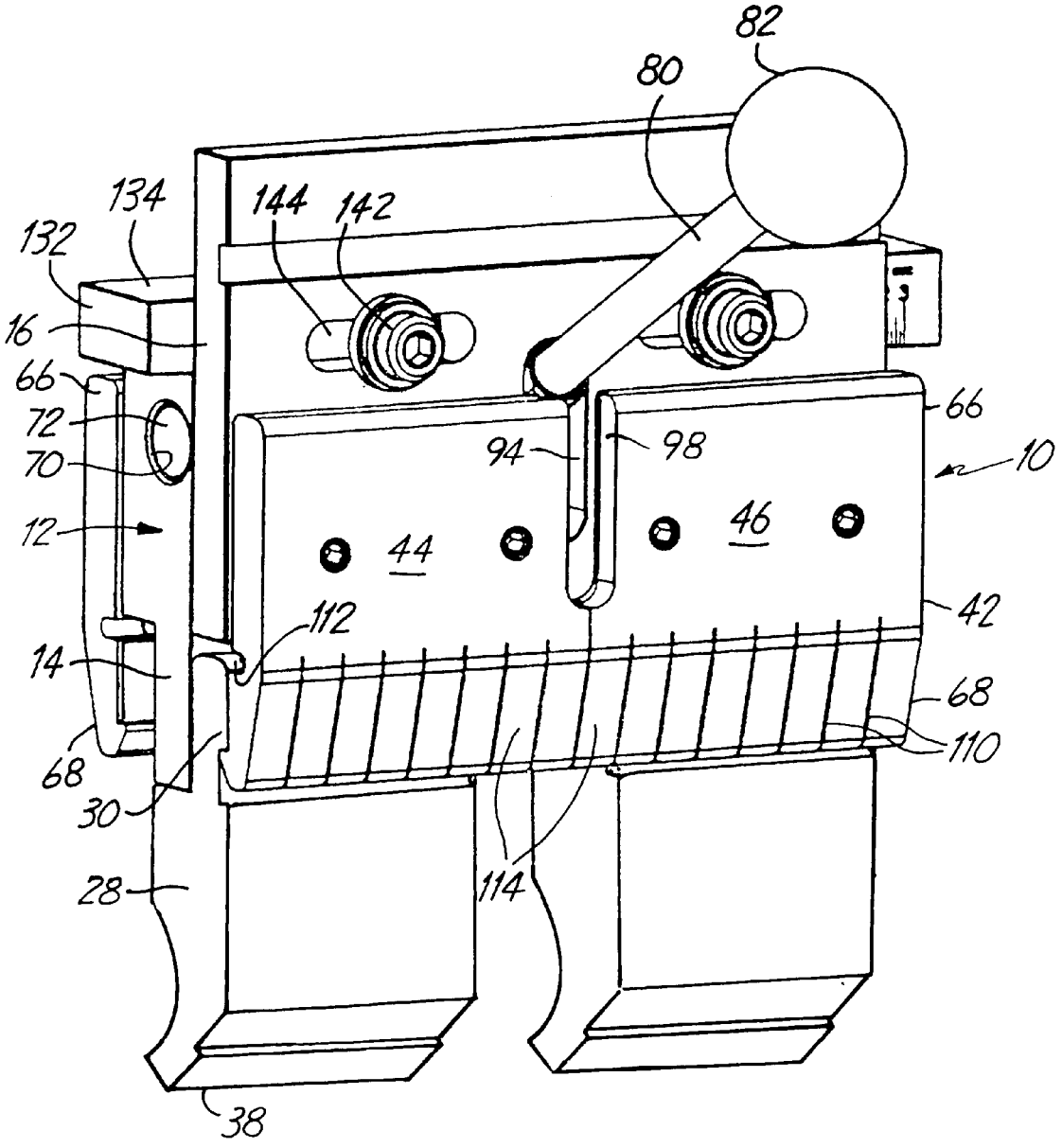
FIG. 1 is a perspective view of a brake press tool holder of the invention with attached tooling.
Figure 3:
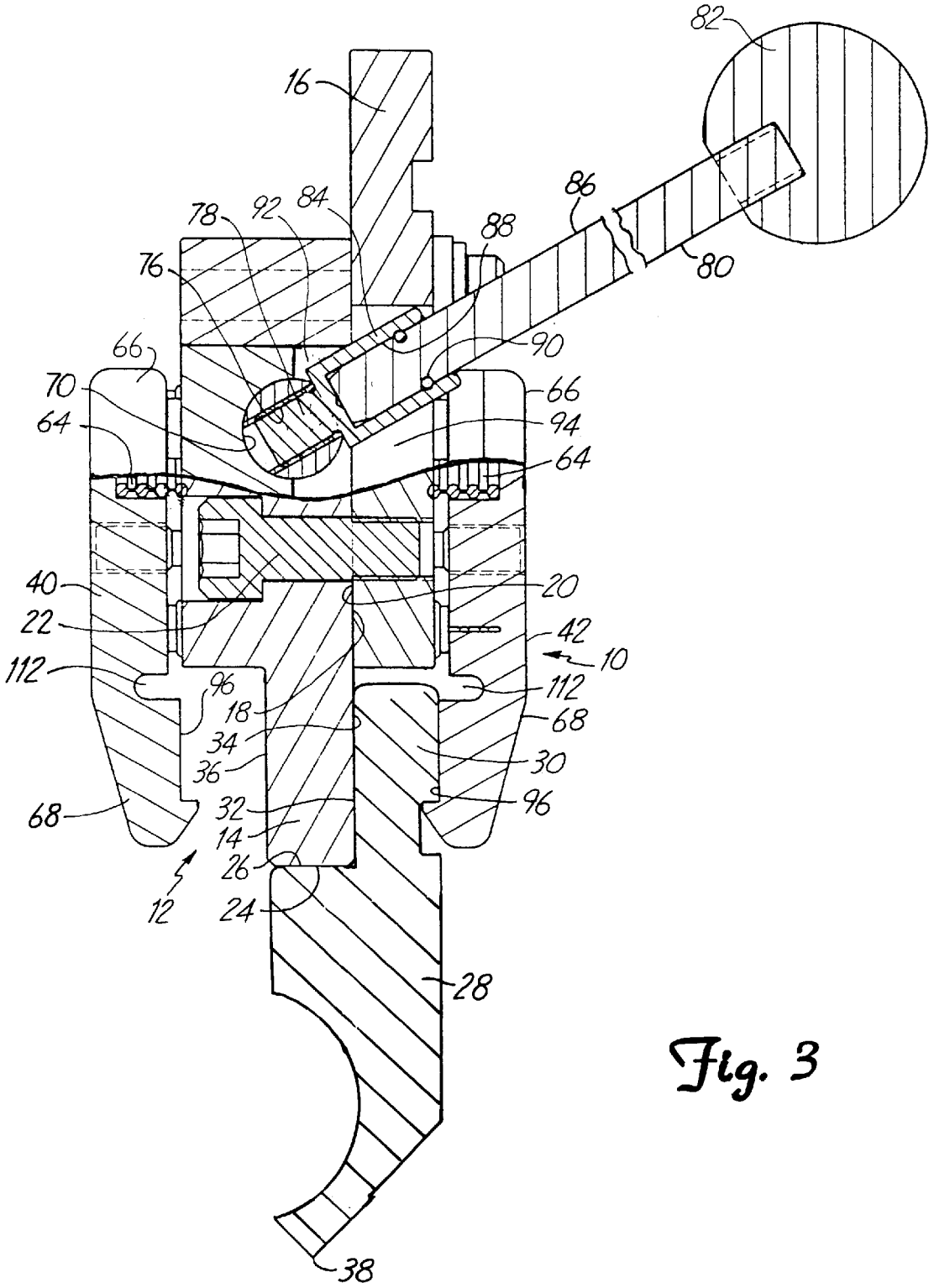
FIG. 3 is a broken-away view, in partial cross section, of the tool holder of FIG. 1.

Referring particularly to FIG. 1, the tool holder of the invention is designated 10, and comprises a horizontally elongated body shown generally as 12, the body including a downwardly extending support plate 14 to which is attached a mounting plate 16, the support plate and mounting plate having generally vertical, contiguous surfaces 18, 20, respectively, and being joined together by a threaded bolt 22 as shown in FIG. 3. The support plate includes a downwardly facing shoulder 24 that is adapted to engage an upwardly facing shoulder 26 of a press brake tool 28. The press brake tool has an upwardly extending shank 30 having a vertical surface 32 adapted to contact a surface 34 of the support plate arising from its downwardly facing shoulder 24. This configuration is shown in FIG. 3, the horizontal shoulder 24 and vertical surface 34 of the support plate encountering the horizontal shoulder 26 and vertical surface 32 of the press brake tool 28. From FIGS. 3–5, it will be noted also that the support plate 14 also has a vertical surface 36 which, in cooperation with its bottom shoulder 24, can support the vertical surface 32 and upper facing shoulder 26 of a tool 28 when the same is reversed. FIG. 3 depicts a press brake tool 28 having a lower, workpiece-encountering edge 38, and it will be understood that the orientation of this edge with respect to the tool holder remains constant regardless of which side of the support plate the shank 30 of the tool is mounted on.

Clamps 40, 42 are mounted to the sides of the body, one of the clamps 40 being mounted to the support plate 14 and the other clamp 42 being mounted to the mounting plate 16.

Figure 2:
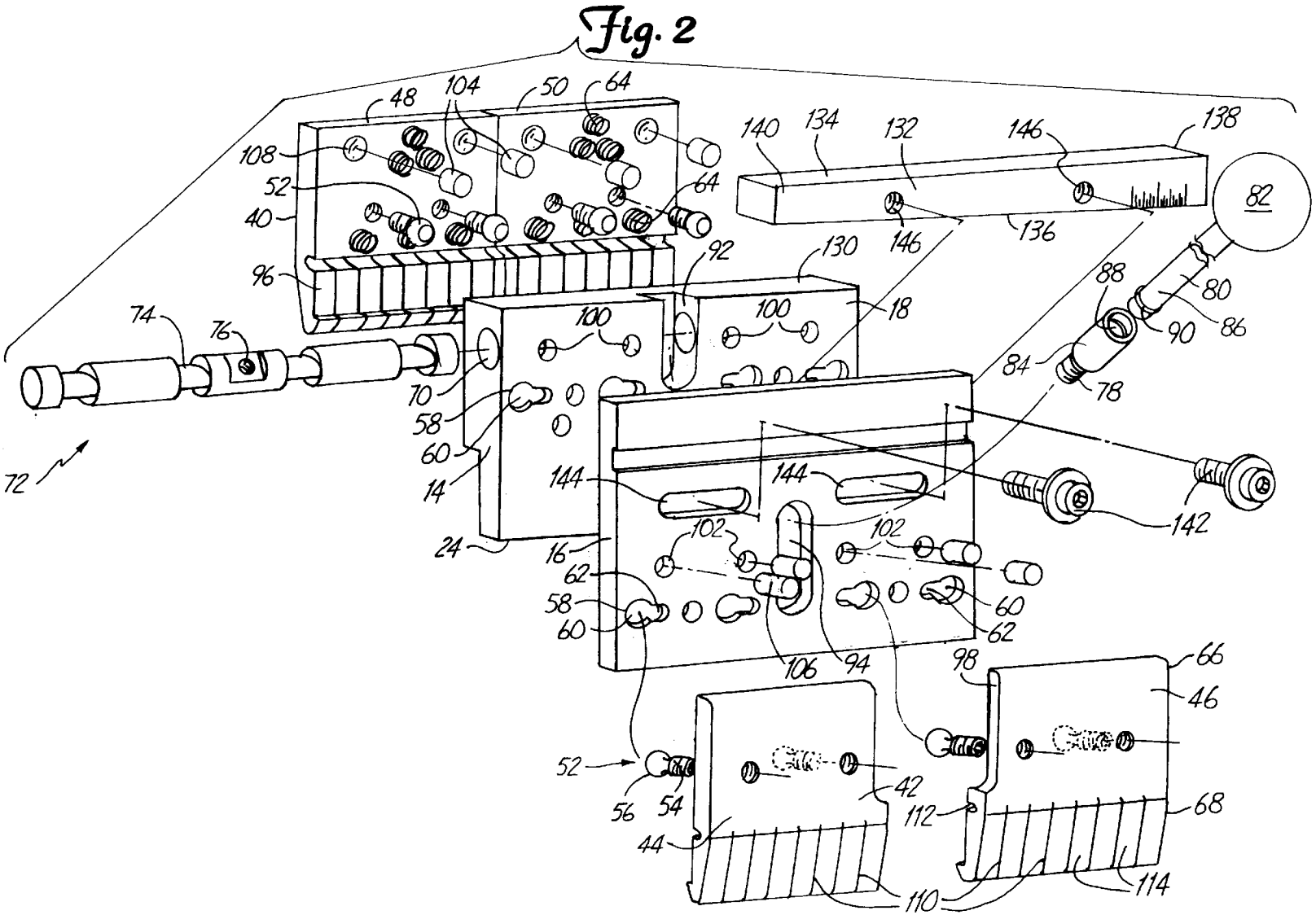
FIG. 2 is a exploded perspective view of the tool holder of FIG. 1.

FIGS. 1 and 2 depict a preferred embodiment in which each mounting plate is composed of two sections that are substantial mirror images of one another, that abut horizontally along the width of the tool holder, and which can be separately removed. With reference to FIG. 2, the clamp 42 thus is composed of a first unit 44 and a second unit 46. Clamp 40 is composed of a first unit 48 and a second unit 50.

Each clamp half is provided with a pair of horizontally spaced pins 52, each pin having a threaded end 54 that is received in a threaded bore formed in the clamp. Each pin has an enlarged, rounded head 56. As shown perhaps best in FIG. 2, the support plate 14 and the mounting plate 16 each include a plurality of horizontally aligned apertures 58. Each aperture forms a horizontally elongated slot having an enlarged end opening 60 and an undercut slot portion 62. The enlarged, rounded heads 58 of the pins are sized so as to be received through the enlarged end openings 60 of the slots. When in this position, the individual clamps are slid horizontally toward the center line of the tool, the enlarged, rounded heads 58 sliding into engagement with the undercut surfaces 62 of the slots. In this manner, each clamp half can be released from the clamping tool by sliding the clamp horizontally away from the midline of the tool until the pins become aligned with the enlarged openings 60, whereupon the clamp halves can simply be removed from the support plate and mounting plate, respectively.

A series of compression springs 64 are mounted between the confronting surfaces of the clamp and the support plate or mounting plate, respectively, so that when the enlarged, rounded ends 56 of the pins are received within the undercut surfaces of the slot 62, the springs 64 tend to push the clamps away from the support plate and mounting plate so that each clamp is tethered to the body by the pins 52. The confronting surfaces of the clamps and the respective support plate and mounting plate are provided with recesses to receive and support the ends of the springs. Note that the pins 52 separate each clamp into an upper portion 66 and a lower portion 68 so that as the upper clamp halves are forced to diverge, that is, are moved away from the respective support plate and mounting plate, respectively, the bottom portions of the clamps converge toward the respective vertical surfaces 34, 36 of the support plate, pivoting occurring about the axes defined by the centers of the rounded, enlarged pin end portions 56.

A horizontal bore 70 is formed through the length of the support plate 14, as shown in FIG. 2. Rotatably fitted within the bore 70 is a cam shaft 72 as shown best in FIG. 2, the cam shaft having a generally circular cross section along its length and including spaced camming sections which may be oval or generally elliptical as shown at 74. The midsection of the cam shaft is provided with a flat surface having a bore 76 threaded to receive the threaded end 78 of a handle 80. The handle may comprise a handle assembly including a manually operable knob 82 at one end, a portion 84 which contains the exteriorly threaded end portion 78 at its other end, and an intermediate shaft portion 86 that is telescopically received within a bore 88 in the portion 84 and releasably held in the bore by a resilient O-ring 90, all of which is shown best in FIG. 3. The support plate 14 is provided with a central, vertical slot 92 at its upper edge such that when the cam shaft 72 is fully received within the bore 70 and the threaded end 78 of the handle is received in the threaded hole 76, the handle can be moved upwardly and downwardly through the slot 92. Similarly, an elongated slot 94 is formed through the thickness of the mounting plate 16 in alignment with the slot 92, the handle 80 passing through the slot 94 and the latter slot enabling the handle to be moved easily between an upper position shown in FIG. 4 and a lower position as shown in FIG. 5, the handle thus moving in a plane perpendicular to the axis of the cam shaft 72. Moreover, the two clamp portions 44, 46 which oppose the mounting plate 16 have confronting recessed surfaces as shown at 98 in FIG. 1 and FIG. 2 that define an upwardly open slot enabling motion of the handle in the manner previously described.

Figure 4:
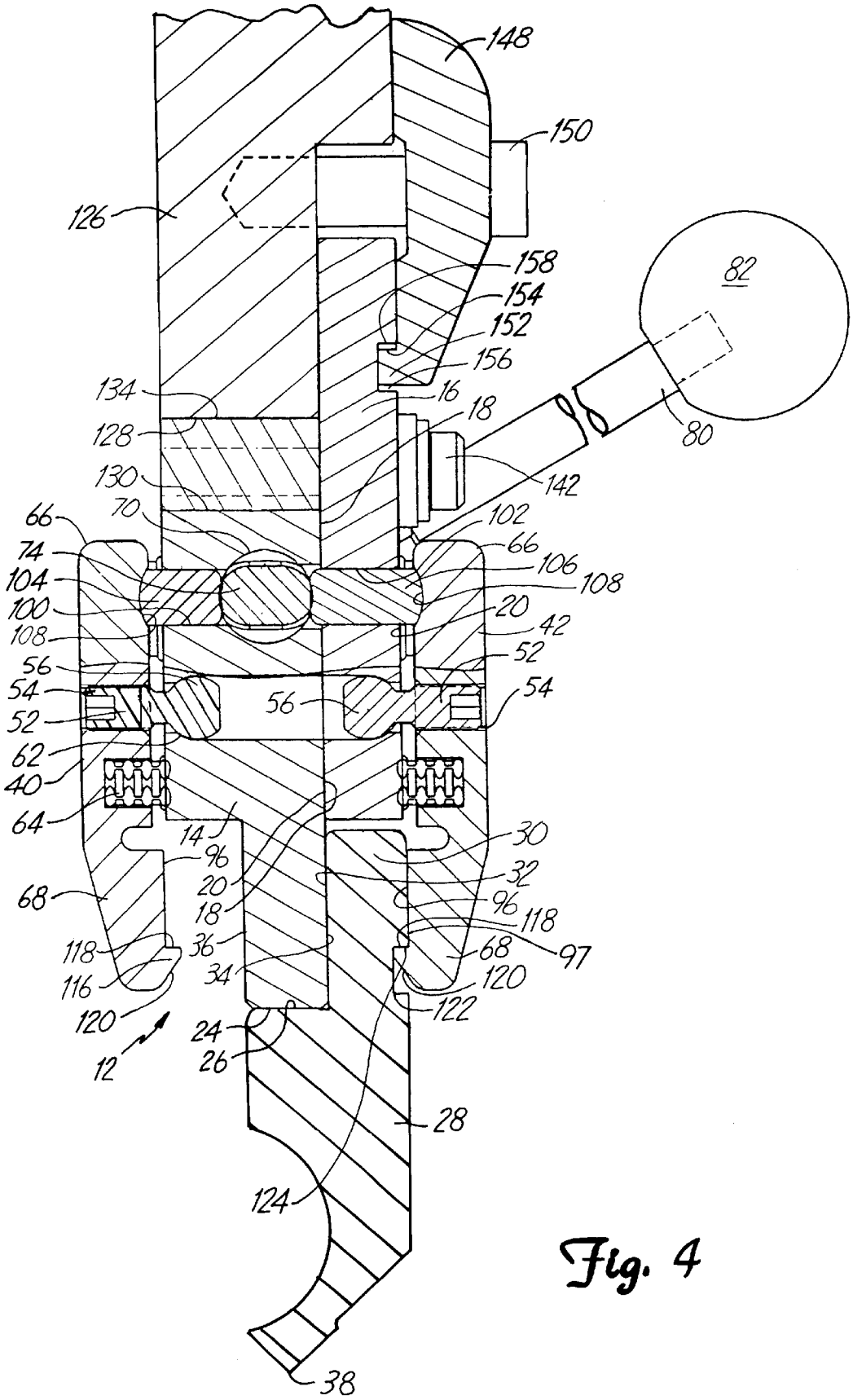
FIG. 4 is a cross-sectional view of the tool holder of FIG. 1 in its tool clamping position.
Figure 5:
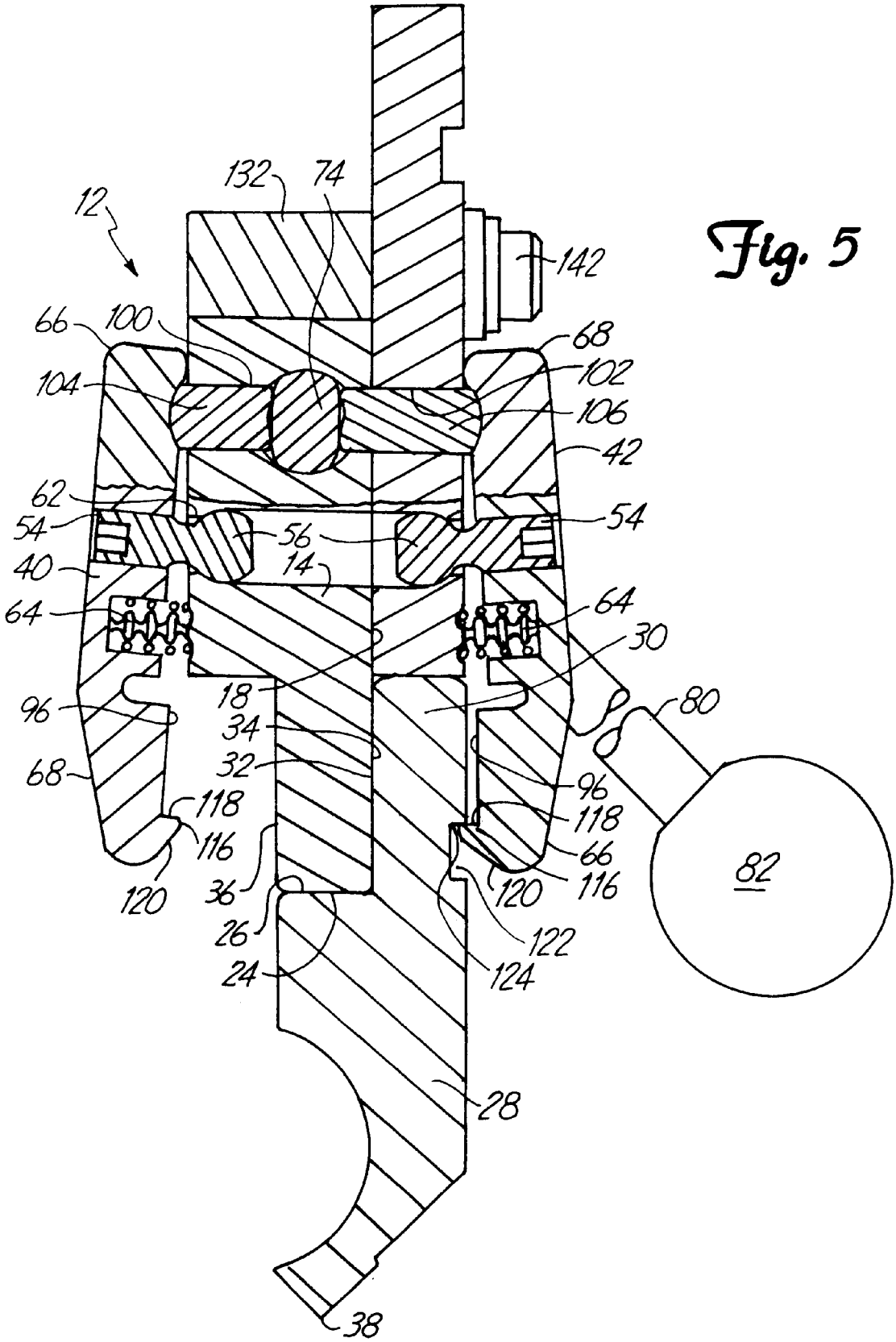
FIG. 5 is a cross-sectional view similar to that of FIG. 4 but showing the tool holder in an unclamped position.

With reference to FIGS. 2, 4 and 5, it will be seen that aligned bores are formed transversely through the thickness of the support plate and mounting plate, the bores intersecting the bore 70 within which the cam shaft 72 is received, the bores being in line with the portions of the cam shaft having oval camming surfaces 74. The transverse bores formed in the support plate are designated 100, and those in the mounting plate as 102. Within these bores are positioned sliding cam follower pins that extend between the camming sections 74 of the cam shaft and the upper portions of the clamps. The cam follower pins between the cam shaft and the clamp 40 are designated 104 and the cam follower pins between the cam shaft and the clamp 42 are designated 106. Those ends of the cam follower pins that engage the oval camming surfaces of the cam shaft preferably are slightly concave, whereas the outer ends of the cam follower pins are preferably slightly convex so as to engage hemispherical recesses 108 formed in the confronting surfaces of the clamps.

As shown best in FIGS. 1 and 2, the lower clamp portion 68 of each clamp is provided with a series of spaced, parallel, thin slots 110 that extend laterally through the clamp and that thus divide the lower section of the clamp into a series of downwardly extending finger elements 114, each of which is capable of resiliently and independently engaging the shank of the tool. In a preferred embodiment, as shown in FIG. 1, a slot 112 is formed in the clamp and extends horizontally along the clamp length at approximately the position at which the slots 110 terminate upwardly, the slot 112 providing the individual finger elements 114 with increased resiliency. Inasmuch as the finger elements 114 independently resiliently engage the shank of the tool, slight imperfections in the holder or in the forming tool shank is readily accommodated.

Operation of the tool holder with respect to clamping and unclamping is perhaps best described in connection with FIGS. 4 and 5 in which clamping of a tool at the right-hand side of the tool holder is depicted. As discussed above, the bottom portion of the mounting plate 14 includes vertical surfaces, 34, 36 and a downwardly facing shoulder 24. In the embodiment of FIGS. 4 and 5, a tool 28 is shown with its upwardly facing shoulder 26 abutting shoulder 24 of the support plate, and the vertical surface 32 of the tool shank engaging vertical surface 34 of the support plate. The clamps, at their lower ends, have inwardly turned lips 116, each lip having an upwardly facing shoulder 118 and an upwardly and inwardly sloping surface 120. Tool shank 30 has a complimentary configuration comprising a slot 122 formed to receive the lip 116, the slot having a downwardly facing shoulder 124 adapted to engage, as a safety measure, the upwardly facing shoulder 118 of the clamp lip. The springs 64, in cooperation with the mounting pins and slots, resiliently maintain the clamp in position so that the spacing between the lip 116 of the clamp and the confronting surface 34 of the support plate is slightly less that the width of the tool shank. As a result, even when the clamp is in its unlocked position, the lip 116 remains at least loosely seated in the slot 122.

Referring first to FIG. 5, the tool holder of the invention is shown in its unclamped position as the shank 30 of a tool has been lifted into position within the holder, the lip 116 of the clamp being received within the slot 122 in the shank of the tool. In this position, the bottom portions 68 of the clamps are permitted to pivot outwardly from the body, as shown, against the pressure of the springs 64 (FIG. 3), enabling the shank of tool 28 to be received between the right-hand clamp in FIG. 5 and the support plate 14. Here, the shoulders 24 and 26 of the tool and support plate engage each other, as do the respective vertical surfaces 32 and 34 of the tool shank and support plate. Note in FIG. 5 that the oval cam shaft portion 74 has been rotated so that its major axis is vertical, permitting the cam follower pins 104, 106 to slide inwardly toward the cam shaft axis as the bottom portions of the clamps are separated from each other.

Manual movement of the handle 82 upwardly into the position shown in FIG. 4 causes the oval cam 74 to rotate so as to bring its major axis toward approximate alignment with the cam follower pins 102, 104, the cam 74 driving these pins outwardly against the upper portion of the clamps and forcing the lower portions 68 of the clamps to pivot toward one another. As the bottom portion 68 of the right-hand clamp closes upon the shank 30 of the tool, the tool is clamped securely in the holder. Each clamp moves independently of the other. If one clamp was removed, for example, the other would still operate as described.

Shown in cross section at 126 in FIG. 4 is the horizontally extending bed of a press brake, with the mounting plate 16 of the tool holder mounted to the bed in a manner described below. Between the bottom shoulder 128 of the press brake bed, which extends substantially horizontally, and the upwardly facing shoulder 130 of the support plate 14, which is slightly angled to the horizontal, is positioned a wedge 132 having upwardly facing and downwardly facing surfaces 134, 136, respectively. The latter surfaces encounter the respective shoulders 128, 130. As shown best in FIG. 2, the wedge 132 tapers in height from one end 138 to the other 140, the taper of the wedge compensating precisely for the non-horizontal surface 130 of the support plate so that the bottom surface 24 of the support plate is horizontal and parallel to the upper surface 134 of the wedge. Thus, the distance between the bottom edge 38 of the tool and the shoulder 128 of the press brake bed can be adjusted by movement of the wedge to the left or to the right in FIG. 2. Once the exact height of the tool edge 38 has been attained, the wedge is locked in place by means of threaded bolts 142 which pass through horizontally elongated slots 144 formed in the mounting plate and thence into threaded holes 146 in the wedge. In this manner, the mounting plate and wedge are held securely together, and when the threaded bolts 142 are loosened, the wedge together with the bolts 142 can be moved to the left or to the right (as shown in FIG. 2) as desired to achieve the correct vertical position of the tool edge 38.

Referring again to FIG. 4, the mounting plate 16 of the tool holder of the invention may be mounted to the bed 126 of a press brake by means of a generally "C" shaped clamp 148, the latter extending preferably horizontally along the length of the tool holder. The C clamp 148 is joined to the bed by means of a threaded screw 150 that passes through the C clamp into the bed 126. At its lower edge, the C clamp 148 includes an inwardly turned lip 152 having an upwardly facing shoulder 154. The lip is received within a horizontally extending slot 156 in the outer surface of the mounting plate, the slot having a downwardly facing shoulder 158 that confronts the shoulder 154 when the tool holder of the invention is mounted to the bed of a press brake.

When it is desired to mount a press brake tool in a holder of the invention, the latter being clamped to the bed of a press brake as in FIG. 4, the handle 80 is pulled downwardly into the unclamped position shown generally in FIG. 5. The shank 30 of a press brake tool is then pressed upwardly through the space between the lip 116 of the clamp and the confronting vertical surface 34 of the support plate. The space between the clamp and the support plate preferably is not sufficiently wide to receive the shank of the tool. As a result, the upper edge of the shank pushes against the upwardly and inwardly sloped surface 120 of the clamp to force the clamp away from the support plate a sufficient distance to admit the shank of the tool, and as the tool moves upwardly between the clamp and the support plate, the lip 116 snaps into the slot 122 to prevent the tool from falling from the holder. Surfaces 24 and 26 of the support plate and tool, respectively, are brought into engagement, and the handle is moved upwardly into the position shown in FIG. 4, causing the. The cam follower pins 104, 106to be cammed outwardly against the upper portions of the clamps to force the lower portions of the clamps to converge, the surface 96 of the clamp bearing against the confronting surface 97 of the tool shank. The handle is then simply removed from the tool holder by pulling it upwardly and away from the holder, the shaft 86 of the handle escaping from the bore 84. Adjustment may be made to the position of the wedge 132 to adjust the height of the edge 36 of the press brake tool.

When it is desired to release the tool from the holder, the handle 80 is reattached to the holder by inserting the shaft 86 into the bore 84. The handle is pulled by the operator away from the press brake and downwardly into the position shown in FIG. 6 to release the clamping pressure of the clamp 42 against the tool shank 30. When the handle has been thus moved to the unclamped position, the presence of the lip 116 in the slot of the tool shank tends to prevent the tool from accidentally dropping from the holder. Rather, the tool is maintained somewhat loosely between the clamp and the support plate, the lip of the clamp restraining the tool from dropping.

Figure 6:
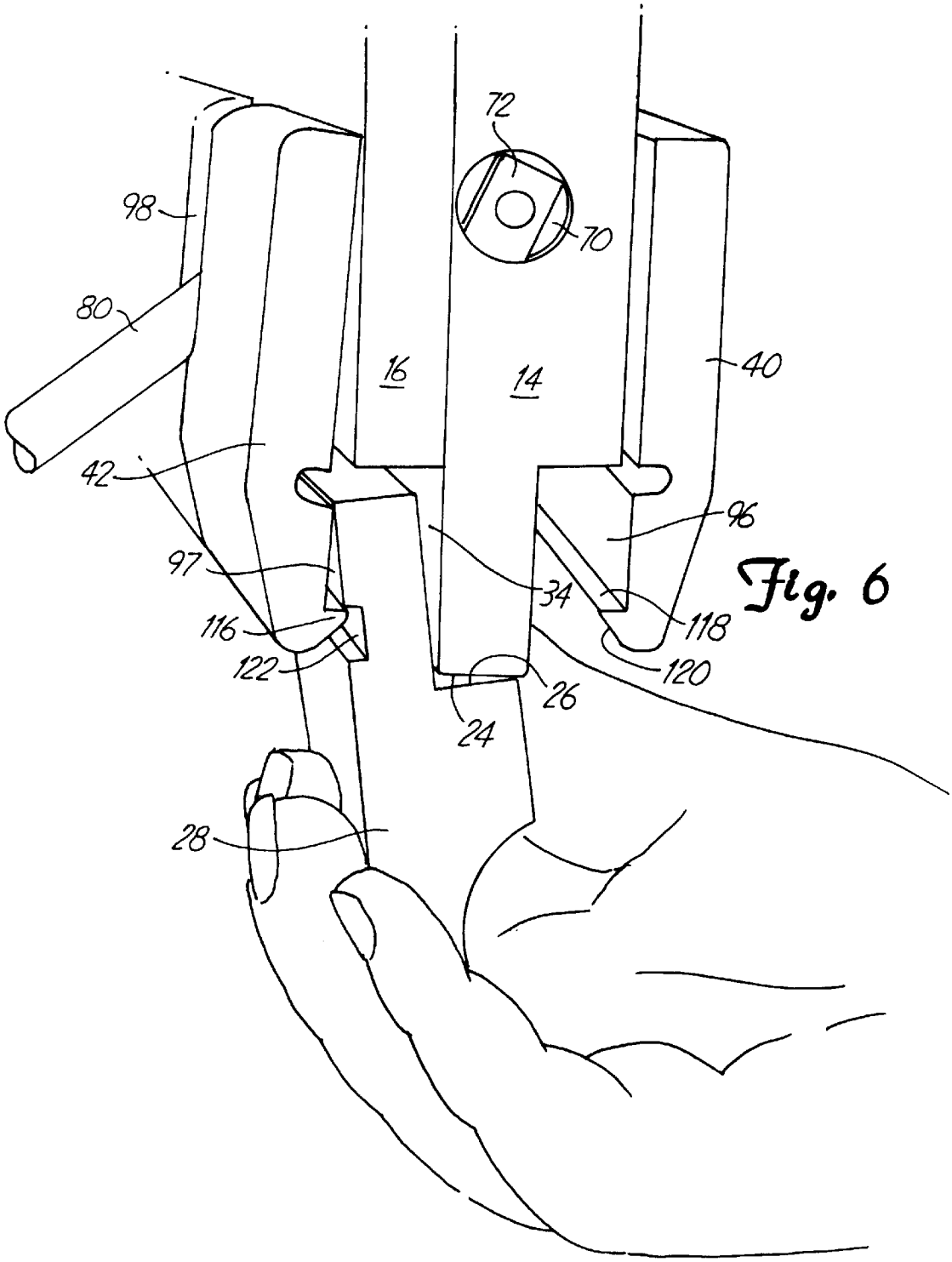
FIG. 6 is a perspective, broken-away schematic view of the tool holder of FIG. 1, showing removal of tooling from the holder.

At this point, the tool can be horizontally slid from the tool holder unless there is other structure in the way. Preferably, however, the tool is removed from the holder by manually grasping the tool as shown in FIG. 6 and pulling its lower end away from the clamp 42. This movement causes the tool shank to pivot about the bottom edge of the support plate 14, the upper edge of the tool shank pressing outwardly upon the clamp which in turn resiliently pivots outwardly to enable the lip 116 of the clamp to escape from the slot 122 in the tool shank. A worker may use both hands to perform this task, reducing the chance of accidentally dropping the tool.

The tool holder of the invention can be readily removed from the bed of a press brake by simply unscrewing the bolts 150. With reference particularly to FIG. 4, it will be noted that as the bolt 150 is unscrewed from the press brake bed, the C clamp 148 is loosened. However, the upwardly facing shoulder 154 of the lip 152 remains in contact with the downwardly facing shoulder 158 of the slot formed in the mounting plate and tends to prevent the tool holder from accidentally or unintentionally dropping from the C clamp. Once the bolt 150 has been loosened appropriately, the tool holder can be grasped manually, the lip of the C clamp can be removed from the slot 156, and the tool holder can be safely lowered from the bed of the press brake. While a preferred embodiment of the present invention has been described, it should be understood that various changes, adaptations and modifications may be made therein without departing from the spirit of the invention and the scope of the appended claims.

What is claimed is:

1. A holder for mounting to a press brake a press brake tool having a horizontally elongated mounting shank, the holder comprising a horizontally elongated body having a support plate, a cam shaft rotatably supported by the body and having a plurality of camming surfaces located axially along its length, a horizontally elongated clamp having upper and lower portions and pivotally attached between said upper and lower portions to the body, the body including a plurality of horizontally spaced cam follower elements positioned between respective camming surfaces and the upper portion of the clamp to force the upper portion of the clamp away from the body in response to rotation of the cam shaft, thereby forcing the lower portion of the clamp toward said support plate to clamp the mounting shank of the tool between the lower portion of the clamp and said support plate.

2. The holder of claim 1 wherein said cam follower elements are rigid and define a mechanically rigid linkage between the camming surfaces of the cam shaft and the clamp.

3. The holder of claim 2 wherein the support plate has a first generally vertical surface confronting said clamp and an oppositely facing generally vertical second surface, the holder including a second of said clamps confronting the second surface of the support plate, said mechanically rigid linkage between the camming surfaces of the cam shaft and the respective clamps forcing each clamp into its clamping position independently of the other clamp.

4. The holder of claim 1 including a plurality of mounting pins extending from one of the clamp and the body and terminating in enlarged heads having aligned articulating surfaces defining a horizontally extending pivot axis, the other of said clamp and body having slots positioned to receive and articulate with said enlarged heads as the clamp is pivoted about the pivot axis.

5. The holder of claim 4 wherein said slots include portions of increased width defining entryways admitting passage of said enlarged mounting pin portions into said slots and enabling easy removal and attachment of the clamp.

6. The holder of claim 5 wherein said slots include along their lengths a portion having a surface configured to articulate with an articulating surface of an enlarged head of a respective mounting pin.

7. The holder of claim 6 including a plurality of compressible elements between the clamp and body and urging upper and lower portions of the clamp away from said body, whereby said clamp can be easily removed from said body by pressing the clamp toward the body to compress said compressible elements and by concurrently sliding the clamp horizontally with respect to the body to align the enlarged heads with the slot entryways.

8. The holder of any one of claims 1–7 including a handle attached to the cam shaft and movable in a plane normal to the axis of the cam shaft to rotate the cam shaft and force the clamp between clamped and unclamped positions.

9. A holder for mounting to a press brake a press brake tool having a horizontally elongated mounting shank, the holder comprising a horizontally elongated body having a support plate, a horizontally elongated clamp having upper and lower portions and pivotally attached between said upper and lower portions to the body for movement about a pivot axis between clamped and unclamped positions, a plurality of mounting pins extending from one of the clamp and the body and terminating in enlarged heads having aligned articulating surfaces defining a horizontally extending pivot axis, the other of said clamp and body having slots positioned to receive and articulate with said enlarged heads as the clamp is pivoted about the pivot axis, said slots including portions of increased width defining entryways admitting passage of said enlarged mounting pin portions into said slots and enabling easy removal and attachment of the clamp by aligning said enlarged mounting pin portions with the respective entryways.

10. The holder of claim 9 wherein each slot includes along its length spaced from its entryway a portion having a surface configured to receive and articulate with an articulating surface of an enlarged head of a respective mounting pin.

11. The holder of claim 10 including a plurality of compressible elements positioned between the clamp and body to resiliently urge upper and lower portions of the clamp away from said body, whereby said clamp can be easily removed from said body by pressing the clamp toward the body to compress said compressible elements and by concurrently sliding the clamp horizontally with respect to the body to align the enlarged heads with the slot entryways.

12. The holder of claim 11 including a horizontally aligned pair of said clamps mounted to said body and individually removable from the body.

13. The holder of any one of claims 9–12 including a handle movable in a plane normal to said pivot axis, and means responsive to movement of the handle to pivot the clamp between clamped and unclamped positions.

14. A holder for mounting to a press brake a press brake tool having a horizontally elongated mounting shank, the holder comprising a horizontally elongated body having a support plate, a pair of horizontally elongated and aligned clamps having upper and lower portions and pivotally attached between said upper and lower portions to the body for movement about a pivot axis between clamped and unclamped positions, a plurality of mounting pins extending from each clamp and terminating in enlarged heads having aligned articulating surfaces defining a horizontally extending pivot axis, the body having slots positioned to receive and articulate with said enlarged heads as the clamp is pivoted about the pivot axis, said slots including portions of increased width defining entryways admitting passage of said enlarged mounting pin portions into said slots and enabling easy removal and attachment of each clamp by sliding it with respect to the body to align said enlarged mounting pin portions with the respective entryways.

15. A press brake tool and a holder for mounting the tool to a press brake, the press brake tool having a horizontally elongated mounting shank with a horizontally extending slot providing a downwardly facing shoulder and a downwardly extending workpiece engaging portion, the holder comprising a horizontally elongated body having a support plate and a horizontally elongated clamp having upper and lower portions and pivotally attached between said upper and lower portions to the body for movement about a pivot axis between a clamped position in which said mounting shank is captured between the lower portion of the clamp and the support plate and an unclamped position in which the tool can be removed from the holder, said clamp having a lip with an upwardly facing surface configured to engage and support the downwardly facing surface of said slot, the holder including a plurality of compressible elements between the clamp and body, said elements being so positioned and arranged as to position the clamp in its unclamped position with said lip within said slot in the mounting shank to restrain accidental release of the tool from the holder, and wherein said tool shank includes a bearing surface above the horizontal slot positioned to bear against the clamp, whereby, when the clamp is in its unclamped position and the lower portion of the tool is manually grasped and urged toward said support plate, the bearing surface of the tool shank forces the lower portion of the clamp to pivot away from the support plate with concurrent escape of the clamp lip from the slot in the tool shank to permit removal of the tool.

16. The holder and tool of claim 15 wherein said tool shank includes a bearing surface above the horizontal slot positioned to bear against the clamp, whereby, when the clamp is in its unclamped position and the lower portion of the tool is manually grasped and urged toward said support plate, the bearing surface of the tool shank forces the lower portion of the clamp to pivot away from the support plate with concurrent escape of the clamp lip from the slot in the tool shank to permit removal of the tool.

17. A holder for mounting to a press brake a press brake tool having a horizontally elongated mounting shank, the holder comprising a horizontally elongated body having a support plate, a cam shaft rotatably supported by the body and having a plurality of camming surfaces located axially along its length, a horizontally elongated clamp having upper and lower portions and pivotally attached between said upper and lower portions to the body, the body including a plurality of horizontally spaced cam follower elements positioned between respective camming surfaces and the upper portion of the clamp to force the upper portion of the clamp away from the body in response to rotation of the cam shaft, thereby forcing the lower portion of the clamp toward said support plate to clamp the mounting shank of the tool between the lower portion of the clamp and said support plate, said holder including a plurality of mounting pins extending from one of the clamp and the body and terminating in enlarged heads having aligned articulating surfaces defining a horizontally extending pivot axis, the other of said clamp and body having slots positioned to receive and articulate with said enlarged heads as the clamp is pivoted about the pivot axis.

18. The holder of claim 17 including a handle attached to the cam shaft and movable in a plane normal to the axis of the cam shaft to rotate the cam shaft and force the clamp between clamped and unclamped positions.

19. The holder of claim 1 wherein said elongated body includes an upwardly extending mounting plate having spaced from its upper end a horizontally extending slot having a downwardly facing shoulder, the holder including a safety clamp for mounting it to the bed of a press brake, the safety clamp comprising an elongated body mountable to a press brake bed and having a horizontally extending lip defining an upwardly facing shoulder engagable with the downwardly facing shoulder of the mounting plate and restraining the tool holder from accidentally dropping from the safety clamp when the latter is loosened from the press brake bed.

* * * * *